US007678414B2

(12) United States Patent
Kessler et al.

(10) Patent No.: US 7,678,414 B2
(45) Date of Patent: Mar. 16, 2010

(54) ROLLABLE FLOOR MAT WITH NON-SLIP SURFACE

(75) Inventors: Ronald Kessler, Girard, OH (US); David M. Neill, Boardman, OH (US)

(73) Assignee: R & L Marketing and Sales, Inc., Youngstown, OH (US)

( * ) Notice: Subject to any disclaimer, the term of this patent is extended or adjusted under 35 U.S.C. 154(b) by 0 days.

(21) Appl. No.: 12/317,101

(22) Filed: Dec. 19, 2008

(65) Prior Publication Data

US 2009/0110820 A1 Apr. 30, 2009

Related U.S. Application Data

(62) Division of application No. 11/346,111, filed on Feb. 2, 2006, now abandoned.

(51) Int. Cl.
*B05C 1/12* (2006.01)

(52) U.S. Cl. ..... 427/202; 427/204; 427/205; 427/336

(58) Field of Classification Search ..... 427/202, 427/204, 205
See application file for complete search history.

(56) References Cited

U.S. PATENT DOCUMENTS 3,227,604 A * 1/1966 Morgan ..... 428/40.6
6,132,844 A * 10/2000 Altshuler et al. ..... 428/143

* cited by examiner

*Primary Examiner*—Frederick J Parker
(74) *Attorney, Agent, or Firm*—Robert G. Lev

(57) ABSTRACT

Thin gage, rollable plastic vinyl floor mats can be provided with an abrasive and grit coating that will not deteriorate or degrade when the mats are rolled or otherwise substantially deformed. A special blend of epoxy adhesive and MEK is used to permanently bond the grit to the vinyl surface.

7 Claims, 1 Drawing Sheet

ROLLABLE FLOOR MAT WITH NON-SLIP SURFACE

PRIORITY INFORMATION

This application is a Divisional Application of U.S. patent application Ser. No. 11/346,111 filed Feb. 2, 2006, now abandoned, to which reference is made herein in its entirety.

FIELD OF INVENTION

The present invention relates generally to safety floor mats made of plastic (vinyl), and to providing a raised, perforated, mat surface suitable for damp locations. More specifically, the present invention is directed to rollable plastic mats with abrasive upper surfaces.

BACKGROUND OF THE INVENTION

Perforated, flow-through rubber or plastic floor mats are useful for providing a safe, non-slip surface for people and other traffic moving in damp locations. This is accomplished by keeping the feet of the pedestrians above damp or particulate-rich, encumbered, or otherwise slippery floors. Liquid or particulate matter flows through perforations, formed by space between both upper and lower ribs, as depicted in the appended drawings. As a result the upper surface of the mat is kept relatively clear of liquid or particles.

Conventionally, the upper surface of the floor mat is constituted by a number of narrow, parallel, plastic or rubber strips, or ribs. Usually these are separated by a distance of approximately the width of an individual rubber strip, as depicted by the appended drawings. Often, such strips have anti-skid corrugations on their top surfaces to provide a high-friction walking surface, since smooth vinyl can become slippery under some conditions.

However, in many cases, the anti-skid structures on the top surfaces of the upper portion of the floor mat can create additional hazards. For example, the structures such as corrugations may hold loose particulate matter, rendering that mat's surface more slippery than that possible with a smooth upper surface. Also, it has been discovered through use that sometimes corrugated surfaces do not exhibit as much friction as that provided by smooth flat mats.

It is well known that some fluids can form a film on smooth, plastic mat surfaces, rendering them unacceptably dangerous. Consequently, some floor mat systems are designed so that upper surfaces are coated with an abrasive grit material that will not allow formation of a liquid slick on the mat's surface, and will provide additional traction because of the abrasive nature of the grit.

It is well known to apply a binder such as urethane and abrasive grains to an upper surface of the mat. Then the binder is cured to produce a coated, abrasive, non-slip product. Eventually, one or more coats are applied over the abrasive grains, and then cured, to help hold the abrasive grains, or grit to the mat surface.

A number of curing techniques are well known, and include heat or radiation curing. This is very common in the application of abrasive mineral particles, also known as grit, to polyvinyl chloride mating. As disclosed in U.S. Pat. No. 4,336,293, incorporated herein by reference, the process for making the mat includes placing the mat in an oven for 30 minutes at 120° C. to partially cure the mat. Then the grit particles are applied covered with an overcoat, known as a sizing coating. The mat is then cured in an oven at 130° C. for four hours.

The various forms of heat and radiation curing are well known. A number of examples are found in the following patents: U.S. Pat. Nos. 5,033,979; 4,345,545; 4,385,239; 4,457,766; 4,547,204; 4,588,419; 4,336,293; 4,196,243; and, U.S. Pat. No. 4,608,287. All of the aforementioned patents are incorporated herein by reference as constituting background material depicting conventional techniques for adhering grit to plastic surfaces.

Normally the industrial processes for producing such mats are long and complex, dealing with a number of intermediate steps, and the use of such additional elements as craft release paper, photosensitizer, or other complicating elements. All of this contributes added cost to the overall industrial process.

A major problem with all of the aforementioned techniques resides in the substantial processing times needed to attach the grit to the plastic surfaces. Most of the processes include heat treatment or radiation treatment, further adding time and expense to the manufacturing process on a final product that is meant to be inexpensive. To save time and expense in the processing, a number of alternatives have been proposed. Of particular interest is the use of urethane adhesive to hold the abrasive grit to a plastic mat surface.

Urethane adhesives work very well with plastic material, and are very easy to apply for purposes of adhering grit to the surface of a plastic structure. Because of the fast acting characteristics of urethane, multiple processes can be rapidly carried out as multiple coats of urethane and grit are added to the plastic surface. The result is excellent non-skid surface suitable for safety floor mating, or other related uses.

Unfortunately, there are limitations to the final product. The mats that are treated with urethane to hold this abrasive grit are vulnerable to loosening and loosing the grit under certain conditions. If the plastic mats are bent, rolled, otherwise distorted, the grit will be loosened and come away from the mat, creating a hazard in itself, and eventually leaving a bare plastic surface on the mat. The same problems are found with epoxy adhesives.

In order to prevent this from happening, it is accepted manufacturing technique to apply the grit held by epoxy or urethane adhesive to only relatively thick, inflexible mat sections. Normally, such mats are not meant to be moved, and are usually held in raised frameworks on a floor or other substrate. Examples of such holding arrangements and relatively thick mats are found in the following U.S. patents: U.S. Pat. Nos. 6,740,380; 6,635,331; 6,531,203; 6,444,284; 6,440,525; 6,352,757; 6,319,584; 6,127,015; 6,068,908; 6,042,915; 5,882,764; and, U.S. Pat. No.5,985,538. All of the aforementioned patents are incorporated with herein by reference as depicting the conventional state of the floor mat art.

All of the aforementioned arrangements are meant to hold floor mat sections in a fixed, unmoving arrangement. These are generally very effective arrangements, but have certain drawbacks. For example, frameworks must be erected to hold the mat sections. This is often time consuming and awkward. It is also very difficult to remove the frames for cleaning or redistribution of the mat sections. In many cases, indentations or recesses are made in the floor or substrate in order to accommodate a relatively thick mat section. Mat sections must remain relatively rigid in order to avoid deformation and loss of the grit material. This means that the mat section must be relatively thick, and thus heavy. As a result, they are often difficult to remove for cleaning underneath them.

In many situations requiring floor mats, light, rollable floor mats are used because they can be easily adjusted, and easily removed for cleaning. Examples of light gage (approximately ¼ inch to ½ inch thick) mat systems are depicted in the following U.S. patents: U.S. Pat. Nos. 6,578,324; 6,405,495;

and, U.S. Pat. No.5,992,105. All of these are incorporated by reference as depicting the state of light gage plastic floor mats. These mats are light, easy to use and deploy, and can be rolled so that the floor underneath can be easily cleaned. Unfortunately, they also have a bit of limitation.

The plastic upper surfaces of these mats are constituted by a series of ribs or strips that have smooth upper surfaces. When grease or oil are allowed to collect, these surfaces can become slick and the mats may become somewhat slippery. Accordingly, such mats would benefit from the application of permanent grit upper surfaces. Unfortunately, rolling of the mats or other substantial deformation may cause conventional grit arrangements to come loose. Even heat-treated, polyvinyl chloride surfaces may not be capable of holding grit when rolled or otherwise substantially deformed.

Accordingly, there is a need for an arrangement to hold abrasive grit to the upper surface of a light, rollable floor mat without loosening or degrading the grit on the plastic matting material. Consequently, an improved floor mat would be produced by a process that is both simple, and time-efficient. Further, the process would not require substantial additional equipment or expertise.

SUMMARY OF THE INVENTION

It is the first object of the present invention to overcome the drawbacks of conventional safety floor mat systems.

It is another object of the present invention to provide a thin, light-gage safety floor mat with an abrasive grit upper coating.

It is further object of the present invention to provide a thin plastic floor mat with an abrasive grit coating that will remain adhered to the plastic mat despite folding or substantial deformation of the floor mat.

It is an additional object of the present invention to provide a thin, light-weight plastic floor mat with an abrasive coating without necessitating substantial additional manufacturing time, or additional special equipment.

It is still another object of the present invention to provide a thin, flexible plastic floor mat with an adhesive grit coating, which is attached to the plastic using common, easily-applied materials.

It is yet a further object of the present invention to provide a thin plastic floor mat that is sufficiently malleable without the addition of a plasticizer.

These and other goals and objects of the present invention are achieved by a rollable perforated plastic floor mat constituted by multiple strips, and including: an epoxy adhesive with a methyl ethyl ketone (MEK) additive applied to an upper layer of the multiple plastics strips. A non-removable grit layer is applied to the epoxy adhesive layer on the multiple plastic strips.

In a second embodiment of the present invention, a process for making a rollable perforated plastic floor mat is provided. Upper surfaces of the multiple strips have a non-removable grit coating on at least the upper straps. The process includes the step of applying an epoxy adhesive layer with a methyl ethyl ketone (MEK) additive on at least an upper surface of the multiple strips. Then, a layer of grit is permanently applied to at least the adhesive layer.

BRIEF DESCRIPTION OF THE DRAWINGS

FIG. 1(*b*) is an end elevational view of FIG. 1(*a*), depicting an end of a representative mat which the present invention can be applied.

FIG. 1(*c*) is a side view diagram of FIG. 1(*a*), depicting another side of a representative floor mat to which the present invention can be applied.

DETAILED DESCRIPTION OF THE PREFERRED EMBODIMENTS

Figure 1C:
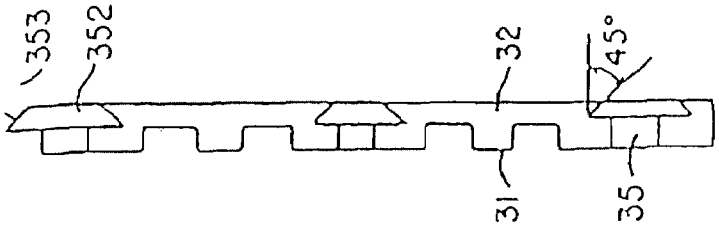
FIG. 1(*a*) is a top view diagram of a representative mat system to which the present invention can be applied.
Figure 1A:
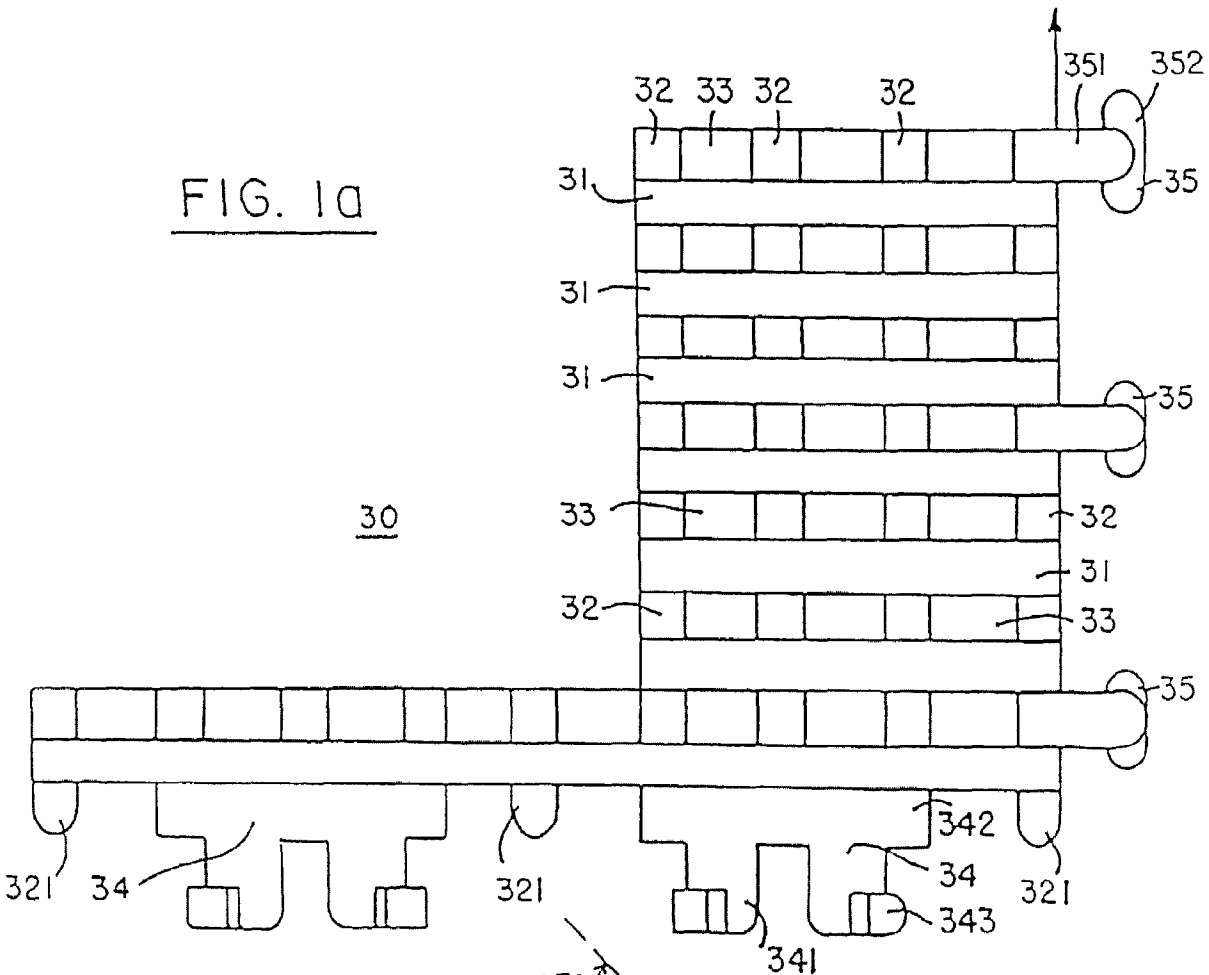
Figure 1B:
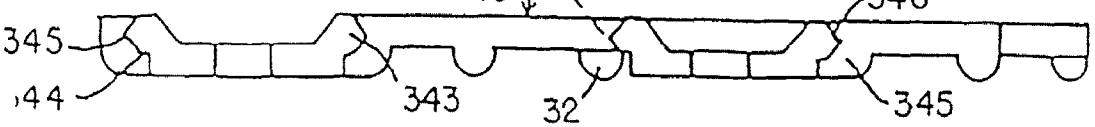

FIGS. 1(*a*)-1(*c*) depict a well known light gage (¼ inch) mat that serves as the environment for the present invention. While the depicted mat is a flow through grid arrangement, other arrangements can be used. Further, mats of virtually any thickness can be used with the present invention. However, the present invention is most applicable to thin, rollable mats (¼ inch to ½ inch classes) that tend to loose their grit when rolled or otherwise deformed. Using the techniques of the present invention, the rolling of thin or light gage mats will not cause the abrasive grit to be lost or loosened, as occurs in the conventional art.

The subject mat is made in sections of vinyl plastic, and formed by injection molding in a conventional manner. This technique is simple and cheap, and can provide relatively complex configurations of grids, such as those depicted in the figures. Each subject mat section is first injection molded, using a conventional vinyl compound, treated in a conventional manner. The mat section is then cooled so that it could be removed from the mold in a conventional manner.

The vinyl mat is removed from the mold and further cooled in a conventional manner. If the vinyl mat section was being used without adhesive grit surface, it would be ready for shipment at this point. However, the addition of the adhesive grits upper surface would normally add a number of complex steps through the manufacturing process. Even with a variety of complex operations, with the conventional art, there is usually a very good chance that the grit will not stay on the mat sections when they are deformed. The product would otherwise be ready for shipment. Using the techniques of the present invention subsequent steps of adding the abrasive grit coatings are relatively simpler and easier than those involved with the conventional art.

The mat sections are first primed wiping them with a methyl ethyl ketone (MEK) or an isopropyl soaked cloth. This can be done by unskilled labor, using only rags. Next, an epoxy mixture is provided. In one embodiment of the present invention a particular blending ratio between the epoxy resin and the amine hardener has been found to be efficacious for holding the grit to the vinyl surface. The optimum ratio is approximately 1 part epoxy resin to 1.5 parts amine hardener. However, other ratios (for example between 1:1.25 and 1:1.75) between the epoxy resin and the amine hardener can be used within the scope of the present invention. The present invention can be practiced with any ratios permitted for the operation of the epoxy adhesive. Since the ratio will vary with the type of epoxy adhesive, there is a moderately wide range of possibilities involved.

A crucial aspect of the present invention is the addition of a five percent (5%) amount of weight (of the existing epoxy resin and hardening mixture) of MEK to the epoxy-hardener mixture. It has been found tat the MEK thins the epoxy mixture, making it more workable. The addition of the MEK also adds to the strength of the overall resulting product. Because the MEK serves to soften the epoxy adhesive, the vinyl is allowed to more easily accept or form the resulting bond which includes the epoxy. Because of variations in vinyl and types of epoxy, the amount of MEK that is added can also very over a range of between .1% through 7.5% by weight of the total epoxy mixture. However, with the epoxy specified, the optimum range is between 4% and 5% by weight.

Also, the use of the epoxy with the MEK additive permits an effective adhesive layer for vinyl ranging in hardness from 40 to 110 durometers without the requirement of a polymeric plasticizer (a standard requirement in the conventional part). By avoiding the use of the polymeric plasticizer, the overall process and product become substantially less expensive. However, it should be understood that the use of a polymeric plasticizer can still take place within the concept of the present invention.

An example of an epoxy resin that can be used is manufactured under the trademark Resiweld Adhesive. It is constituted by epoxy resin, Biphenol A, diglycidyl ether, calcium carbonate and crystalline silica. The amine hardener is made up of polyamide resin, calcium carbonate, tricthylcnctentramine, aliphatic amine, and crystalline silica. Both the epoxy resin and the amine hardener are manufactured by HB Fuller Company. However, similar epoxies and hardeners provided by other manufacturers can also be used in the prescribed range of ratios. The MEK component can be obtained from any appropriate manufacturer.

The particular balance between the resin, the hardener, and the MEK, in combination with the vinyl is crucial to maintaining flexibility and holding the abrasive grit layer. The MEK helps to "cut" the epoxy, making it easier to manipulate or otherwise work with. The MEK provides just enough additional softening (of both vinyl mat and adhesive) so that flexibility of the overall structure can be maintained.

Once the epoxy is mixed and the vinyl mat is cleaned (preferably with MEK), a first coat is of epoxy is applied to the vinyl mat by using a roll coating device, such as a hard roller. The first coat is approximately half the volume as any subsequent second coat.

The abrasive grit layer is then sprinkled on top of the wet-coated epoxy adhesive on the mat. Generally, the grit is constituted by common silicon carbide and aluminum oxide. There are a wide variety of sources for these materials, which are well-known as abrasive grit. It should be understood that many different types of material can be used as an abrasive grit so that the present invention is not limited to any specified preferred substance.

Next, a second, heavier coat of epoxy mixture is made applied. As with the first coat of epoxy, the second coat is applied with a hand roller. The action of the second roller forces the first coat of epoxy and grit to mix more closely together forming a very secure arrangement. No special skill or tooling is required for the rolling.

Next, a second application of grit is made. Enough grit must be sprinkled across the mat to cover the entire epoxy adhesive coat. Afterwards, the mat section is shaken to agitate it so that all of the loose grit will fall back away from the mat. The mat is then set aside to allow the epoxy to dry.

One advantage of the present invention is that the entire process of adding the grit can be carried out simply and inexpensively, using unskilled labor. However, the present invention need not be confined to this technique. Rather, the aforementioned process of adding the adhesive and the grit can be carried out using automatic machinery. Such machinery has the disadvantage of a necessary capital investment. However, this is somewhat offset by the increased processing speed permitted by the machinery, and the lower costs resulting from precise applications of both adhesive and grit. A substantial amount of time and labor would also be saved in the use of such machinery. The present invention can be practiced entirely with unskilled labor, with automatic machinery, or any combination thereof.

In some cases, depending on how large grit particles are, a single heavier coat may be applied instead of two coats. The use of only a single coat of grit eliminates the large grit from becoming clogged in the roller. This approach also works well with smaller size grits. The size of the grit (and so the number of grit layers) is determined by the environment in which the mat is to be deployed. Accordingly, the present invention is applicable to a wide variety of different mat uses.

The overall process (or any variation thereof) is relatively quick, simple, and can be accomplished with unskilled labor. The result is a thin, rollable floor mat which will maintain its grit surface despite substantial deformation, such as that caused by rolling the mat into a tight cylinder.

The solid grit upper surface of the mat permits relatively light easily moved mats to maintain a non-slip surface even under circumstances that would be unsafe for vinyl floor mats not having the grit surface.

In another embodiment of the present invention, a polyester polymeric non-migrating plasticizer is added to the vinyl mix. This is preferably a plasticizer such as VCCxp-1891, manufactured by Velsicol Chemical Corporation, of Rosemont, Ill. It should be noted that other equivalent polymeric plasticizers can be used instead.

The addition of the polyester polymeric plasticizer, as exemplified above, can alter the characteristics of the molded mat sections, making them far more amenable to subsequent steps of the inventive process. In particular, sometimes an epoxy is able to hold abrasive grit to the surface of the treated vinyl mat far better than a mat that has not been treated with the polyester polymeric plasticizer. Avoiding the use of an expensive polymeric plasticizer is one of the advantages of the present invention. However, it should be understood that the use or absence of the polymeric plasticizer very often depends upon the final product desired. The present invention generally permits the avoidance of the polymeric plasticizer while maintaining hardness factors between 40 and 110 durometers. However, depending upon the final application and environment of the product, variations in these figures are permitted.

It should be understood that by using MEK in the epoxy mixture it is possible to use a highly flexible vinyl compound for the mat section without the use of the aforementioned polyester polymorphic plasticizer. The MEK enhances the adhesive capabilities of the polyester adhesive layer without the necessity of treating the vinyl compound. Further, the use of the MEK as a cleaning agent further enhances the overall process, and results in a superior product having far greater durability and useful life than conventional products.

The present invention is particularly important for the use of light gage (¼ inch or ½ inch thick) vinyl safety floor mats. However, the present invention can be applied to thicker or immobile floor mats as well. The present invention can also be applied on any vinyl surface that might benefit from an abrasive grit, non-slip coating.

While a number of embodiments have been presented by way of example, the present invention is not limited thereto. Rather the present invention should be interpreted as covering any and all variations, permutations, adaptations, derivations, modification and embodiments that would occur to one skilled in this art, once having been taught the present invention. Therefore, the present invention is to be limited only in accordance with the following claims.

We claim:

1. A process for making plastic floor mat constituted by at least one upper surface and having a grit coating on said at least one surface, where said grit is not loosened or degraded when said floor mat is rolled, said process comprising the steps of:

(a) placing a first layer of a mixture of an epoxy adhesive and methyl ethyl ketone on said at least an upper surface and, (b) placing a layer of grit on at least said first layer; and, (c) wherein the methyl ethyl ketone in said first layer operates to soften said epoxy adhesive, and is added to said epoxy adhesive/hardener mixture in the range of between 0.1% and 7.5% by weight of said epoxy adhesive/hardener mixture.

2. The process of claim 1, further comprising the additional steps of:

(d) applying a second epoxy adhesive layer on at least said layer of grit and said at least one upper surface; and (e) placing a second layer of grit on said second layer of epoxy adhesive.

3. The process of claim 1, wherein said mat is formed of multiple strips using a polyester polymeric plasticizer added to a base vinyl material.

4. The process of claim 3, wherein step (b) of placing said epoxy adhesive comprises a preliminary sub-step of cleaning an upper surface of said multiple strips with a substance selected from a group consisting of isopropyl alcohol and methyl ethyl ketone.

5. The process of claim 4, wherein said second coat of epoxy adhesive is applied with a hand roller.

6. The process of claim 1, wherein said plastic floor mat is substantially between one-fourth inch thick and one-half inch thick, and is rollable without loss of grit.

7. The process of claim 1, wherein said epoxy adhesive is formed by approximately 1 part epoxy resin to between 1.25 and 1.75 parts by weight of amine hardener.

* * * * *